US005127339A

United States Patent [19]

Hood, Jr.

[11] Patent Number: 5,127,339

[45] Date of Patent: Jul. 7, 1992

[54] FOLDABLE LAP TRAY

[76] Inventor: John J. Hood, Jr., 163 Exeter, Irvine, Calif. 92715

[21] Appl. No.: 746,327

[22] Filed: Aug. 16, 1991

[51] Int. Cl.[5] ..... A47B 23/00

[52] U.S. Cl. ..... 108/43; 108/42

[58] Field of Search ..... 108/43, 44, 45, 46, 108/42; 220/62, 914

[56] References Cited

U.S. PATENT DOCUMENTS

| | | | |
|---|---|---|---|
| 2,459,921 | 1/1949 | Comer | 220/62 X |
| 2,512,963 | 6/1950 | Peiker | 108/46 X |
| 2,670,124 | 2/1954 | Buchmiller et al. | 108/46 X |
| 2,695,712 | 11/1954 | Kolander | 108/46 X |
| 2,808,191 | 10/1957 | Cramer | 108/46 X |
| 2,916,181 | 12/1959 | Pfister et al. | 220/62 |
| 3,326,445 | 6/1967 | Goings | 108/44 X |
| 4,819,568 | 4/1989 | Coffrin | 108/43 |

*Primary Examiner*—Jose V. Chen

*Attorney, Agent, or Firm*—Klein & Szekeres

[57] ABSTRACT

A foldable lap tray is formed from a unitary blank of semi-rigid sheet material, such as corrugated cardboard. The blank is cut and scored so that it can be bent along the score lines into a configuration having a top portion, side portions extending downwardly from each of two opposed sides of the top portion, and a pair of bottom portions, each extending from one of the side portions toward the other side portion. When the top portion is located on the lap of a seated person, the bottom portions can be extended underneath the thighs of the seated person to lend stability to the tray. The bottom portions terminate in clasping elements for removably interlocking the bottom portions together. The side portions are each divided by a lateral score line into upper and lower side portions that can be bent relative to each other to vary the separation between the top portion and the bottom portions. The top portion is provided with a plurality of flaps that can be bent upwardly out of the plane of the top portion so as to be substantially vertical. The vertically-oriented flaps block objects from rolling or sliding off of the tray surface formed by the top portion.

20 Claims, 2 Drawing Sheets

FIG. 1.
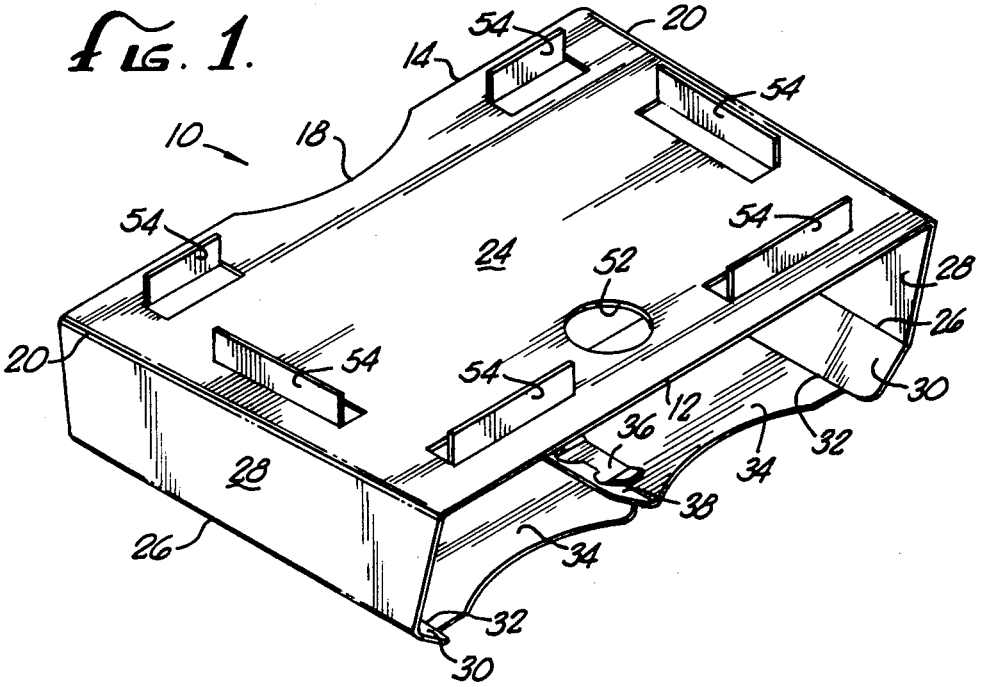
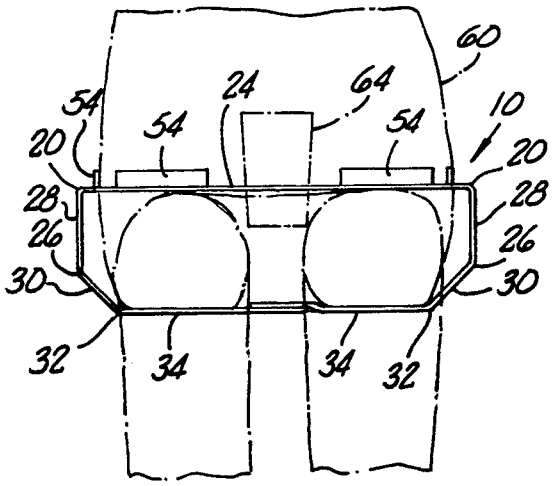
FIG. 2.
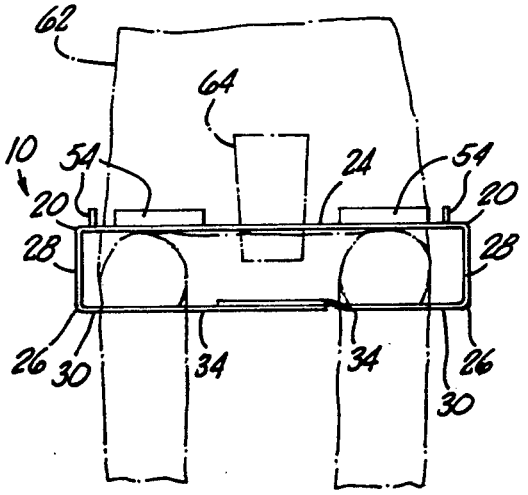
FIG. 3.

FOLDABLE LAP TRAY

BACKGROUND OF THE INVENTION

This invention relates generally to the field of portable trays and the like. More specifically, it relates to a foldable or collapsible tray that can be either self-supporting or supported on a person's lap.

Portable trays, and particularly foldable or collapsible trays, have become widely popular for a variety of uses. They are frequently used, for example, by bedridden persons, by children who want to eat while watching television, and by persons attending picnics or outdoor events.

Several approaches to portable tray design have been taken by the prior art. One approach is that of a collapsible table or tray formed from a sheet of corrugated cardboard or the like, which is cut and scored so that it can be folded to form a table or a tray with a flat top and downwardly-extending sides. For example, U.S. Pat. No. 2,240,024 - Stone et al. discloses a foldable table of this sort that may adapted for use as a beach table or a bed table, depending on its dimensions. An adhesive is used to hold the table together in its folded configuration. Thus, the table or tray, once used, cannot conveniently be collapsed for storage and reuse. U.S. Pat. No. 3,438,345 Lasaine et al. discloses a collapsible table that is similar in concept to the Stone et al. device, but with interlocking components that allow the table to retain its folded configuration without adhesive, so that it may be repeatedly collapsed and refolded for storage and reuse.

Another approach is illustrated in U.S. Pat. No. 2,663,603—Newman and U.S. Pat. No. 2,697,018—Georgides. These patents disclose lap trays having a rigid, planar central portion and side members that extend from under the central portion to engage the outside of a seated person's thighs for stability. Such lap trays exhibit greater structural strength, rigidity, and stability than the folded cardboard trays described above, but they are typically heavier and more expensive, and thus not suitable where light weight is preferred, or for uses, such as outdoor events, in which a disposable tray may be desired.

Thus, it would be advantageous to provide a portable tray that combines the low cost and light weight of the folded cardboard trays, with the strength, rigidity, and stability of those trays having thigh-engaging side members.

SUMMARY OF THE INVENTION

Broadly, the present invention is a foldable lap tray formed from single sheet of material, preferably corrugated cardborad, that is cut and scored sot hat it can be folded to have a float top portion, a pair of downwardly-extending side portions, and a pair of bottom portions that can be extended under, or tucked under, a seated user's thighs, with the top portion resting on the top of the thighs.

In a specific preferred embodiment, the sheet has a central area that forms the tray top. Extending rom each side of the central area is a side portion, and extending from each side portion is a bottom portion. Each of the bottom portions terminates in a clasping element, and the clasping elements can be interconnected to make the tray self-supporting on a surface such as a floor or a table.

The central area advantageously has at least one circular cut-out that functions as a holder for a cup or a glass. The preferred embodiment also includes a plurality of flats spaced around the central area near the edges thereof, the flaps being bendable upwardly out of the plane of the central area, thereby being oriented vertically, perpendicular to the surface of the central area. In this orientation, the flaps serve to keep plates and the like from sliding off of the tray.

Another feather of the preferred embodiment is an intermediate score line in each side portion that allows the side portions to be shortened and the bottom portions proportionately lengthened. In this configuration, the tray is effectively lowered with respect to the overlapping bottom portions, allowing the top or central portion to rest on the tops of the thighs of a person, such as a child, with small legs.

As will be better appreciated from the detailed description that follows, the present invention combines light weight with a good degree of structural rigidity, strength, and stability. Moreover, the device is very economical to manufacture, making it suitable for one-time disposable use, while it is also capable of being collapsed and refolded for reuse. In addition, the tray can be comfortably used by both adults and children.

BRIEF DESCRIPTION OF THE DRAWINGS

FIG. 1 is a perspective view of a foldable lap tray constructed in accordance with a preferred embodiment of the present invention, showing the invention in its normal folded configuration;

FIG. 2 is a front elevational view of the invention in its normal folded configuration, showing the invention being used by a typical adult;

FIG. 3 is a front elevational view of the invention in its lowered folded configuration, showing the invention being used by a small child;

DETAILED DESCRIPTION OF A PREFERRED EMBODIMENT

Figure 4:
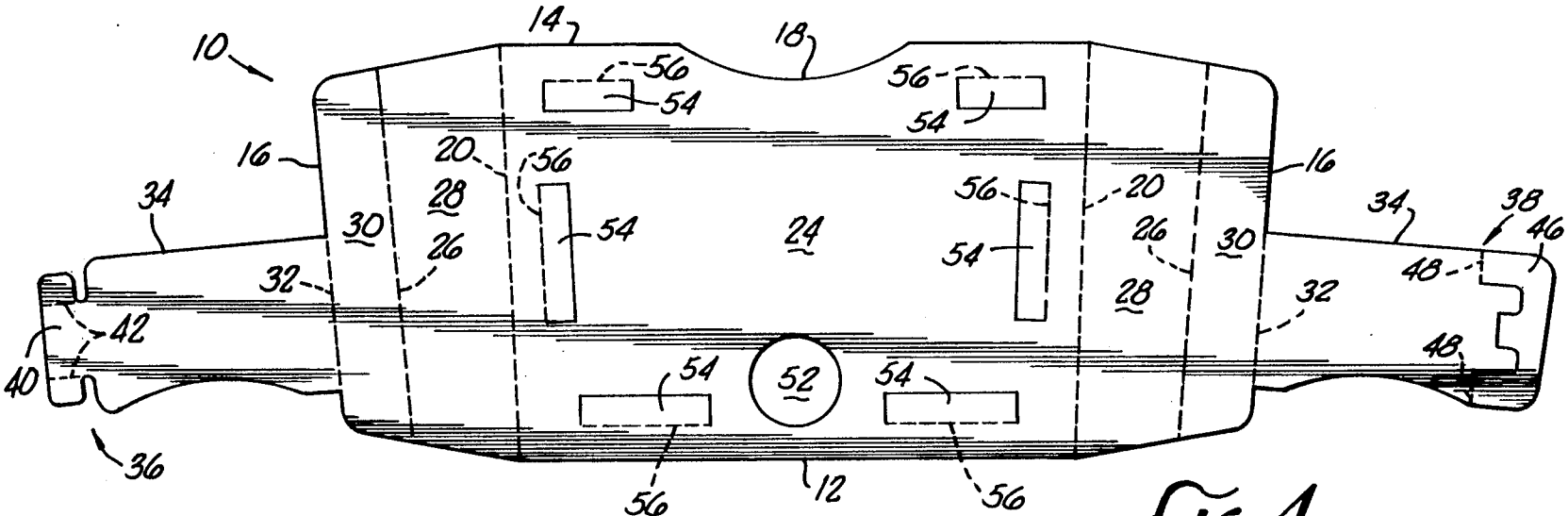
FIG. 4 is a plan view of the invention in its unfolded configuration.

Referring now to the drawings, and particularly FIGS. 1 and 4, a foldable tray 10, in accordance with a preferred embodiment of the present invention, is shown. As best shown in FIG. 4, the tray is formed from a blank of semi-rigid sheet material, preferably corrugated cardboard, that can support light to moderate loads, and that can be bent and folded. The blank is cut to the shape shown in FIG. 4, and scored along a plurality of score lines, indicated by dashed lines in FIG. 4. The cutting and scoring are performed by conventional methods, well-known in the art.

As shown in FIG. 4, the blank has a front edge 12, a rear edge 14, and a pair of opposed lateral edges 16. The rear edge 14 has a central concavity 18, the purpose of which will be made clear below. Extending from the front edge 12 to the rear edge 14 is a pair of first, or inner, score lines 20, which define between them a central area 24 that includes the concave portion 18 of the rear edge 14. Between each of the lateral edges 16 and each of the inner score lines 20 is a second, or intermediate score line 26. The intermediate score lines 26 extend from the front edge 12 to the rear edge 14, and are roughly parallel to the inner score lines 20. As will be described more fully below, an upper side portion 28 is defined between the inner and intermediate score lines on each side of the central area 24, and a lower side portion 30 is defined between each intermediate score line 26 and its adjacent lateral edge 16.

Figure 5:
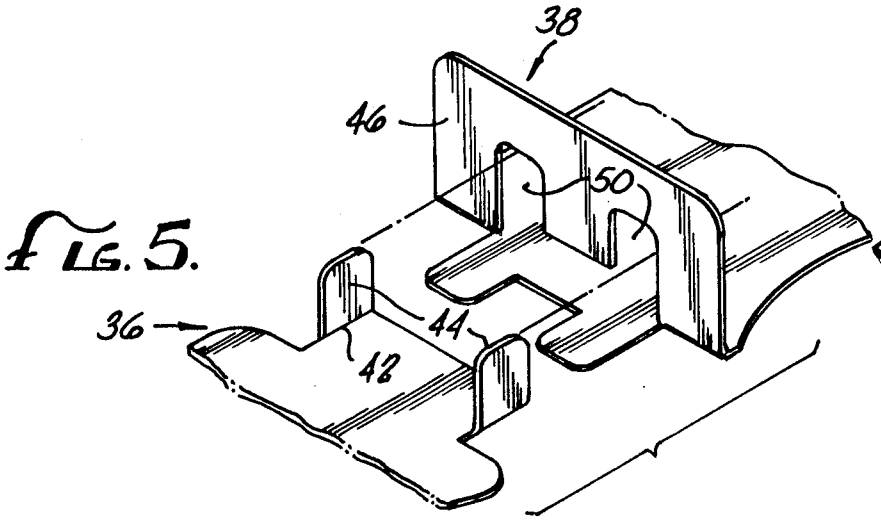
FIG. 5 is a detailed perspective view of the clasping elements employed in the preferred embodiment, showing the clasping elements separated from each other.
Figure 6:
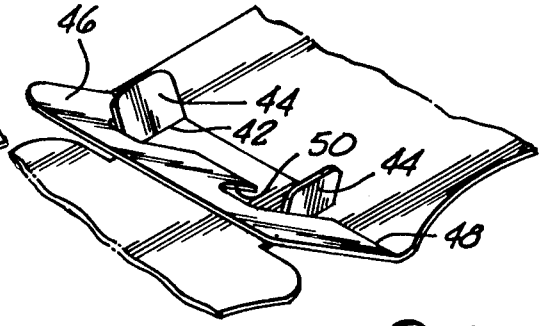
FIG. 6 is a detailed perspective view of the clasping elements, showing them in their interlocked position.

A portion of each lateral edge 16 is defined by an outer score line 32, and extending from each lateral edge 16 along an outer score line 32 is a flap-like bottom portion 34. One of the bottom portions 34 terminates in a male clasping element 36, while the other bottom portion terminates in a female clasping element 38. The clasping elements 36 and 38 are illustrated in detail in FIGS. 5 and 6. The male clasping element 36 includes a lateral strip 40 having opposed ends that are bendable upwardly along score lines 42, to form an opposed pair of vertical tabs 44. The female clasping element 38 includes a generally "M"-shaped end piece 46 that is joined to its associated bottom portion 34 along a pair of lateral, opposed score lines 48. The end piece 46 can be bent upwardly, along its associated end piece score line 48, to expose a pair of parallel, vertical slots 50, each of which receives a tab 44 on the male clasping element 36, as shown in FIG. 6. The tabs 44 are then bent slightly outwardly (away from each other) to engage against the end piece 46, thereby providing an interlocking engagement between the male clasping element 36 and the female clasping element 38.

As shown in FIG. 4, the central area 24 includes a circular cut-out or hole 52 near the front edge 12. The central area 24 is also provided with a plurality of narrow strips or flaps 54 that are cut into the central area 24 and spaced around that area near the front and rear edges and near the inner score lines 20. Each of the flaps 54 is joined to the material forming the central area 24 along a score line 56, allowing the flaps 54 to be bent upwardly so as to be substantially vertical, perpendicular to the surface of the central area, as shown in FIG. 1. The purposes of the hole 52 and the flaps 54 will be explained below.

The use of the tray 10 is shown in FIGS. 1, 2, and 3. When used as a lap tray by a typical adult, the tray is bent along the score lines 20, 26, and 32 into the configuration shown in FIGS. 1 and 2. Specifically, the side portions 28 and 30 are extended downwardly from the central area 24 by bending the blank along the inner score lines 20. The bottom portions 34 are then extended toward each other, under the thighs of a seated user 60, by bending the blank along the intermediate score lines 26 and the outer score lines 32, in the manner shown in FIGS. 1 and 2. When so bent, the central area 24 forms a tray top that rests on the user's lap, or more specifically, on the tops of the user's thighs, with the concavity 18 in the rear edge 14 resting against the user's torso to allow the tray to be closer to the user for greater stability and ease of use. The bottom portions 34 are thus aligned substantially parallel to, and underneath, the central area 24.

For the typical adult user, the upper side portions 28 will extend downwardly, substantially perpendicular to the central area 24. The lower side portions 30 will extend downwardly and toward each other, each forming an obtuse angle with both its accent upper side portion 28 and its adjacent bottom portion 34. The bottom portions 34 will overlap sufficiently to allow an interlocking engagement between the male clasping element 36 and the female clasping element 38, as described above.

When used by an adult who is somewhat larger than average, the lower side portions 30 may need to be substantially coplanar with the upper side portions 28, thereby raising the level of the central area 24 to allow greater clearance for the user's thighs. When so configured, the bottom portions may not overlap sufficiently to allow the clasping elements 36, 38 to interlock.

FIG. 3 shows the tray in use by a small child 62. When so used, the blank is bent along the inner score lines 20 to extend the upper side portions 28 downwardly, substantially perpendicular to the central area 24, as with an adult, but the blank is then bent along the intermediate score lines 26 so as to make the lower side portions 30 extend toward each other, substantially perpendicular to the adjacent upper side portions 28. Thus, the lower side portions will be substantially coplanar with the bottom portions 34, and will at least partially underlie the user's thighs. In this configuration, the bottom portions 34 will be able to overlap sufficiently to achieve an interlocking of the clasping elements 36, 38.

The tray 10 may also be used as a free-standing, self supporting supporting tray or table, in which case it would be configured as shown in FIG. 1.

When the tray is in use, as shown in FIGS. 1, 2, and 3, the cut-out or hole 52 provides means for holding a glass 64 or a cup. More than one such hole may be provided, if desired. The flaps 54, when raised to their vertical positions, provide means for preventing plates, utensils, and the like form sliding off of the tray surface.

When the user is finished with the tray, the clasping elements 36, 38 can be disengaged from one another, and the side portions 28, 30 an d the bottom portions 34 can be folded up against the underside of the central area 24 to collapse the tray for storage and reuse, if desired. In addition, the relatively large, planar central area 24 is well-suited for being printed with decorative designs, advertising messages, logo types, and the like.

It will thus be appreciated that the present invention provides a foldable tray that is light in weight, but which exhibits good stability and structural rigidity and strength. The tray is easy, convenient, and comfortable to use for adults of varying sizes, as well as for children. The tray is economical to manufacture, by well-known, conventional methods, from inexpensive materials, making it suitable for disposable applications, yet it can be stored and repeatedly reused, if desired. In addition, the relatively large, flat central area 24 is well-suited for being printed with decorative designs, advertising messages, logo types, and the like.

Although a preferred embodiment of the invention has been described above and in the accompanying drawings, it will be appreciated that a number of variations and modifications may suggest themselves to those skilled in the pertinent arts. For example, as mentioned above, the number and placement of glass holding cut-outs may be varied, and additional cut-outs may be provided to hold other items, such as bowls. The clasping elements 36, 38 described above may be replaced by hook-and-loop fasteners adhesively fixed to the ends of the bottom portions 34, or by other types of fastening means. These and other variations and modifications should be considered within the spirit and scope of the invention, as defined in the claims that follow.

What is claimed is:

1. A foldable tray formed out of a unitary blank of sheet material, comprising:

a top portion for placement on the lap of a seated person and having a substantially horizontal central area defined between a substantially parallel pair of inner score lines formed in the blank; and leg engaging means, joined to the top portion along each of the inner pair of score lines, for placement around the outside of and under the thighs of the seated person, the leg engaging means comprising:

a substantially vertical side portion joined to the top portion along each of the inner pair of score lines, each of the side portions being defined between one of the inner pair of score lines and one of a substantially parallel pair of outer score lines formed in the blank, the side portions being bent along the inner pair of score lines for placement around the outside of the thighs of the seated person; and a substantially horizontally bottom portion joined to each of the side portions along one of the outer pair of score lines, the bottom portions being bent toward each other along the outer pair of score lines for placement under the thighs of the seated person.

2. The foldable tray of claim 2, wherein the bottom portions include clasping means for removably connecting the bottom portions together when they are bent toward each other 3. The foldable tray of claim 2, wherein the clasping means comprises:

a male clasping element on one of the bottom portions; and a female clasping element on the other bottom portion, the female clasping element including means defining a slot for receiving the male clasping element.

4. The foldable tray of claim 3, wherein the female clasping element includes an end piece with a slot, the end piece being bendable with respect to its associated bottom portion along a score line, and wherein the male clasping element includes means forming a tab that is receivable in the slot and bendable so as to engage the end piece.

5. The foldable tray of claim 1, wherein each of the side portions comprises an upper side portion and a lower side portion joined along an intermediate score line along which the lower side portion is bendable to a portion substantially perpendicular to the upper side portion and substantially coplanar with the adjacent bottom portion.

6. The foldable tray of claim 1, wherein the blank of sheet material has a front edge, a rear edge, and a pair of opposed lateral edges;

wherein the pair of inner score lines extends from the front edge to the rear edge so as to define between them the central area; and wherein each of the pair of outer score lines is spaced from and substantially parallel to one of the inner score lines, each of the outer score lines defining a portion of one of the lateral edges, each of the bottom portions extending from one of the lateral edges along one of the outer score lines, each of the side portions being defined between a lateral edge and one of the inner score lines, whereby the central area defines the top portion when the side portions are bent along the inner score lines so as to be substantially parallel to each other, and whereby the bottom portions are bendable toward each other along the outer score lines so as to be extended underneath the thighs of the seated person.

7. The foldable tray of claim 6, wherein the blank further comprises a pair of intermediate score lines, each extending from the front edge to the rear edge, and each located between one of the inner score lines and one of the outer score lines, thereby dividing each of the side portions into an upper side portion and a lower side portion, each of the lower side portions being bendable along one of the intermediate score lines so as to be substantially perpendicular to its adjacent upper side portion and substantially coplanar with its adjacent bottom portion.

8. The foldable tray of claim 7, further comprising clasping means on the bottom portions for removably connecting the bottom portions together when they are bent toward each other.

9. The foldable tray of claim 8, wherein the clasping means comprises:

a male clasping element on one of the bottom portions; and a female clasping element on the other bottom portion, the female clasping element including means defining a slot for receiving the male clasping element.

10. The foldable tray of claim 9, wherein the female clasping element includes an end piece with a slot, the end piece being bendable with respect to its associated bottom portion along a score line, and wherein the male clasping element includes means forming a tab that is receivable in the slot and bendable so as to engage the end piece.

11. The foldable tray of claim 6, wherein the top portion includes means for restraining articles from sliding off of the top portion, the article restraining means comprising a plurality of flaps cut into the central area near the inner score lines and the front and rear edges, each of the flaps being bendable out of the plane of the central area so as to be substantially perpendicular thereto.

12. A foldable tray formed out of a unitary blank of sheet material, comprising:

a top portion for placement on the lap of a seated person and having a substantially horizontal central area defined between a front edge, a rear edge, and a substantially parallel pair of inner score lines formed in the blank and extending from the front edge to the rear edge; and leg engaging means, joined to the top portion along each of the inner pair of score lines, for placement around the outside of and under the thighs of the seated person, the leg engaging means comprising:

a substantially vertical side portion joined to the top portion along each of the inner pair of score lines, each of the side portions being defined between one of the inner pair of score lines and one of a substantially parallel pair of outer score lines formed in the blank, the side portions being bent along the inner pair of score lines for placement around the outside of the thighs of the seated person; and a bottom portion joined to each of the side portions along one of the outer pair of score lines, the bottom portions being bent toward each other along the outer pair of score lines, so as to underlie and be oriented substantially parallel to the central area, for placement under the thighs of the seated person.

13. The foldable tray of claim 12, wherein the blank further comprises a pair of intermediate score lines, each extending from the front edge to the rear edge between one of the inner score lines and one of the outer score lines, each of the intermediate score lines dividing one of the side portions into an upper side portion and a lower side portion that are bendable with respect to each other along the intermediate score line.

14. The foldable tray of claim 12, further comprising clasping means on each of the bottom portions for removably interconnecting the bottom portions when the blank is bent along the outer score lines so as to bring the bottom portions into the position underlying the central area.

15. The foldable tray of claim 14, wherein the clasping means comprises:

a male clasping element on one of the bottom portions; and a female clasping element on the other bottom portion, the female clasping element including means defining a slot for receiving the male clasping element.

16. The foldable tray of claim 15, wherein the female clasping element includes an end piece with a slot, the end piece being bendable with respect to its associated bottom portion along a score line, and wherein the male clasping element includes means forming a tab that is receivable in the slot and bendable so as to engage the end piece.

17. The foldable tray of claim 12, wherein the top portion includes means for restraining articles from sliding off of the top portion, the article restraining means comprising a plurality of flaps cut into the central area near the inner score lines and the front and rear edges, each of the flaps being bendable out of the plane of the central area so as to be substantially perpendicular thereto.

18. A foldable tray formed out of a unitary blank of sheet material, comprising:

a top portion for placement on the lap of a seated person and having a substantially horizontal central area defined between a front edge, a rear edge, and a substantially parallel pair of inner score lines formed in the blank and extending from the front edge to the rear edge;

leg engaging means, joined to the top portion along each of the inner pair of score lines, for placement around the outside of and under the thighs of the seated person, the leg engaging means comprising:

a substantially vertical side portion joined to the top portion along each of the inner pair of score lines, each of the side portions being defined between one of the inner pair of score lines and one of a substantially parallel pair of outer score lines formed in the blank, the side portions being bent along the inner pair of score lines for placement around the outside of the thighs of the seated person; and a bottom portion joined to each of the side portions along one of the outer pair of score lines, the bottom portions being bent toward each other along the outer pair of score lines, so as to underlie and be oriented substantially parallel to the central area, for placement under the thighs of the seated person; article restraining means in the top portion for restraining articles from sliding off of the top portion, the article restraining means comprising a plurality of flaps cut into the central area near the inner score lines and the front and rear edges, each of the flaps being bendable out of the plane of the central area so as to be substantially perpendicular thereto; and clasping means on each of the bottom portions for removably interconnecting the bottom portions when the blank is bent along the outer score lines so as to bring the bottom portions into the position underlying the central area.

19. The foldable tray of claim 23, wherein the blank further comprises a pair of intermediate score lines, each extending from the front edge to the rear edge between one of the inner score lines and one of the outer score lines, each of the intermediate score lines dividing one of the side portions into an upper side portion and a lower side portion that are bendable with respect to each other along the intermediate score line.

20. The foldable tray of claim 1, wherein the clasping means comprises:

a female clasping element on one of the bottom portions, the female clasping element having an end piece with a slot, the end piece being bendable with respect to its associated bottom portion along a score line; and a male clasping element on the other bottom portion, the male clasping element including means forming a tab that is receivable in the slot and bendable to engage the end piece.

* * * * *

UNITED STATES PATENT AND TRADEMARK OFFICE

CERTIFICATE OF CORRECTION

PATENT NO. : 5,127,339

DATED : July 7, 1992

INVENTOR(S) : John J. Hood, Jr.

It is certified that error appears in the above-identified patent and that said Letters Patent is hereby corrected as shown below:

Column 1, line 55, "sot hat" should be --so that--;

Column 1, line 56, "float" should be --flat--;

Column 2, line 4, "flats" should be --flaps--;

Column 3, line 39, before "perpedicular" insert --or--;

Column 4, line 25, delete "supporting", second instance;

Column 5, line 26, "claim 2" should be --claim 1--;

Column 8, line 31, "claim 23" should be --claim 18--;

Column 8, line 39, "claim 1" should be --claim 18--;

Column 3, line 65, change "accent" to --adjacent--.

Signed and Sealed this

Seventeenth Day of May, 1994

Bruce Lehman

*Attest:*

BRUCE LEHMAN

*Attesting Officer*

*Commissioner of Patents and Trademarks*